US007424800B2

(12) United States Patent
Biermann et al.

(10) Patent No.: US 7,424,800 B2
(45) Date of Patent: Sep. 16, 2008

(54) YARN CLEANER

(75) Inventors: Iris Biermann, Mönchengladbach (DE); Olav Birlem, Schwalmtal (DE); Hans Grecksch, Mönchengladbach (DE); Christoph Haase, Viersen (DE); Gerhard Rienas, Heinsberg (DE)

(73) Assignee: Oerlikon Textile GmbH & Co. KG, Monchengladbach (DE)

( * ) Notice: Subject to any disclaimer, the term of this patent is extended or adjusted under 35 U.S.C. 154(b) by 258 days.

(21) Appl. No.: 10/578,014

(22) PCT Filed: Oct. 13, 2004

(86) PCT No.: PCT/EP2004/011451

§ 371 (c)(1),
(2), (4) Date: May 3, 2006

(87) PCT Pub. No.: WO2005/047155

PCT Pub. Date: May 26, 2005

(65) Prior Publication Data

US 2007/0119144 A1 May 31, 2007

(30) Foreign Application Priority Data

Nov. 10, 2003 (DE) ..... 103 52 429

(51) Int. Cl.
*B65H 69/06* (2006.01)

(52) U.S. Cl. ..... 57/264; 57/22

(58) Field of Classification Search ..... 57/264, 57/22; 700/144

See application file for complete search history.

(56) References Cited

U.S. PATENT DOCUMENTS

| | | | | |
|---|---|---|---|---|
| 3,303,698 | A | 2/1967 | Loepfe | 73/160 |
| 3,577,854 | A | 5/1971 | Felix | 33/1 |
| 4,430,720 | A * | 2/1984 | Aemmer | 702/84 |
| 5,537,811 | A * | 7/1996 | Pidoux et al. | 57/264 |
| 5,592,849 | A * | 1/1997 | Nakade et al. | 73/160 |
| 6,374,152 | B1 | 4/2002 | Wepfer et al. | 700/144 |
| 6,922,604 | B2 * | 7/2005 | Hoeller | 700/144 |
| 2002/0062775 | A1 | 5/2002 | Hoeller | 112/285 |
| 2002/0074445 | A1 | 6/2002 | Oehrl et al. | 242/475.4 |

FOREIGN PATENT DOCUMENTS

| | | |
|---|---|---|
| DE | 15 35 079 | 7/1975 |
| DE | 4020330 A1 | 1/1991 |
| DE | 92 03 819 | 8/1992 |
| DE | 100 62 479 A1 | 6/2002 |
| EP | 0 877 108 A1 | 11/1998 |
| EP | 1 295 835 A2 | 3/2003 |
| WO | WO 00/73189 | 12/2000 |

* cited by examiner

*Primary Examiner*—Shaun R Hurley
(74) *Attorney, Agent, or Firm*—K&L Gates LLP

(57) ABSTRACT

A yarn cleaner for cleaning defects from a yarn, by means of a head for measuring at least one yarn parameter for comparison against cleaning limits determined for the yarn parameter. If the cleaning limits are exceeded, a defect in the yarn is indicated whereby intolerable defects may be cut out from the yarn. The yarn cleaner is set up for cleaning an effect yarn, also called a novelty or fancy yarn, formed from an alternating thinner webs and thickened effects in the yarn. At least one value of the yarn parameter is predetermined for webs and for effects and the cleaning limits of the yarn cleaner are adjusted such that they lie outside the predetermined value of the web parameter and outside the predetermined value of the effect parameter.

17 Claims, 3 Drawing Sheets

YARN CLEANER

CROSS-REFERENCES TO RELATED APPLICATIONS

This application claims the benefit of German patent application 10352429.0, filed Nov. 10, 2003, herein incorporated by reference.

BACKGROUND OF THE INVENTION

The invention relates to a yarn cleaner for cleaning out defects from a yarn and, more particularly, to a yarn cleaner having a measuring head for measuring at least one yarn parameter and wherein, wherein cleaning limits are determined for the yarn parameter for indicating the presence of a defect in the yarn so that intolerable defects may be cut out from the yarn.

In the production of yarn, as high a uniformity as possible of the yarn is generally aimed for within narrow tolerances as well as a yarn without visible defects, such as intolerable thick or thin locations in the yarn. In order to achieve this, so-called yarn cleaners are used, which, for example, monitor the diameter of the yarn continuously with a measuring head which operates contactlessly. If, owing to the exceeding of limit values called cleaning limits, an intolerable defect is detected, the defect is cut out of the yarn, the yarn ends are connected again and the production process is continued, as known, for example from German Patent Publication DE 10062479 A1.

In conventional yarn monitoring, a single reference diameter is determined and cleaning limits selected for this. For example it is known from the literature reference "Elektronisches Garnüberwachungssystem Corolab fur Rotor-Spinnspulautomaten Autocoro", Chemiefasern/Textilindustrie, $40^{th}/92^{nd}$ Volume, April 1990, in order to determine a reference diameter, to determine an average diameter value of the yarn at the beginning of the measurement at a spinning station over the first yarn meters. This so-called reference diameter is the reference diameter for all further evaluations. Measured actual diameters of the yarn are generally given as a percentage based on the reference diameter.

SUMMARY OF THE INVENTION

The object of the invention is to propose a cleaner with an enlarged area of application.

This object is achieved with a yarn cleaner for cleaning out defects from a yarn, by means of a measuring head for measuring at least one yarn parameter for comparison against cleaning limits are determined for the yarn parameter such that, if the cleaning limits are exceeded, this condition signals the presence of a defect in the yarn whereby intolerable defects may be cut out from the yarn. According to the invention, the yarn cleaner is set up for cleaning an effect yarn, sometimes also called a novelty or fancy yarn, which is formed from an alternating arrangement side by side of webs and of effects consisting of predetermined thickenings in the yarn. At least one value of the yarn parameter is predetermined for webs and for effects of the effect yarn and the cleaning limits of the yarn cleaner are adjusted such that they lie outside the predetermined value of the web parameter and outside the predetermined value of the effect parameter.

Further advantageous configurations and embodiments of the invention are described below.

The yarn cleaner according to the invention makes it possible to recognize diameter-related yarn defects even in effect or novelty yarns. The fluctuations in the yarn parameter, which are caused solely by the change between the webs and effects, do not result in unnecessary cutting processes, which would reduce the productivity and create undesired connection locations.

If different cleaning limits are specified for the web and effect, the determination of effects can take place virtually as precisely as in a yarn free of effects.

The cleaner functions known per se, can therefore be extensively used so a satisfactory evaluation of the effect yarn produced is possible.

If, in an effect yarn, defects can be either tolerated in the web regions or defects can be tolerated in the effect regions, the yarn cleaner can be set up such that, alternatively, either only defects in the web regions are cleaned out or only defects in the effect regions are cleaned out. The selection of only the effects can be justified in that satisfactory web formation is assumed, but the effect formation is not reliable enough. If, as an alternative, it can be assumed that differences in the effect formation are of no consequence, it may be sufficient if only the longer web sections are cleaned, analogously to a regular yarn. With the restriction to one alternative, the calculating outlay required for the cleaning and the number of cutting processes can be reduced.

The diameter of the effect yarn is used as a priority as the yarn parameter, with the cleaning limits being different depending on the respective measuring location, in other words web or effect.

To determine the average value of the web diameter $D_{ST}$, the yarn cleaner initially forms an arithmetic average value of the yarn diameter from a predetermined length of effect yarn as the reference diameter, subtracts the reference diameter from the individual values of the yarn diameter and forms the average value of the web diameter $D_{ST}$ as the arithmetic average value of all the negative differential values, which have been measured adjacent to other negative differential values. Thus, the web diameter, also called the web thickness, can be determined largely uninfluenced by the effects and therefore close to reality. This also has a positive effect with regard to the accuracy of detecting the effect.

The yarn cleaner may be set up such that it determines the effect region by defining the beginning of the effect according to the fulfillment of a first criterion and by defining the end of the effect according to the fulfillment of a second criterion, between the beginning and the end of the effect. A specifiable number of the largest diameters is determined, an arithmetic average value is formed from the diameters determined, which is specified as the diameter of the effect, and the region of the effect yarn outside the effect is defined as the web region. With a yarn cleaner set up in this manner, a relatively simple but adequately precise determination of the effect limits is possible.

The diameter $D_E$ of the effect is formed as the average diameter value from the four largest diameters between the beginning and end of the effect. In this development of the yarn cleaner, an average value for the effects, which is set too low, is counteracted. On the one hand, an average value, which is set low, could lead to undesired cuts when the effect is strongly pronounced, partially deliberately. On the other hand, an inadequate differentiation of the cleaning limits between the effect and web would exist.

The first criterion as described above may be considered as the exceeding of a limit diameter $D_{GR}$, which is greater by a defined amount than the average value of the web diameter $D_{ST}$ when the exceeding lasts over a predetermined yarn length $L_{V1}$ and the second criterion may be considered as the falling below of the limit diameter $D_{GR}$ when the falling below lasts over the predetermined yarn length $L_{V2}$. With such a yarn cleaner, the limit between the web and effect can be determined with adequate accuracy for cleaning the effect yarn.

If lower demands are placed on the cleaning of an effect yarn with regard to maintaining the diameter, the yarn cleaner may be set up in such a way that its cleaning limits are adjusted such that they lie outside the fluctuation width $B_S$ of effect and web. With a yarn cleaner of this type, the outlay required for cleaning the effect yarn can be reduced. On the other hand, it is nevertheless ensured that unnecessary steps, which are brought about by effect-caused diameter fluctuations, are not carried out. A cleaner of this type is adequate particularly when the effects are not particularly strongly pronounced.

BRIEF DESCRIPTION OF THE DRAWINGS

The invention will be described in more detail with the aid of an embodiment. In the drawings.

DESCRIPTION OF THE PREFERRED EMBODIMENTS

Figure 1:
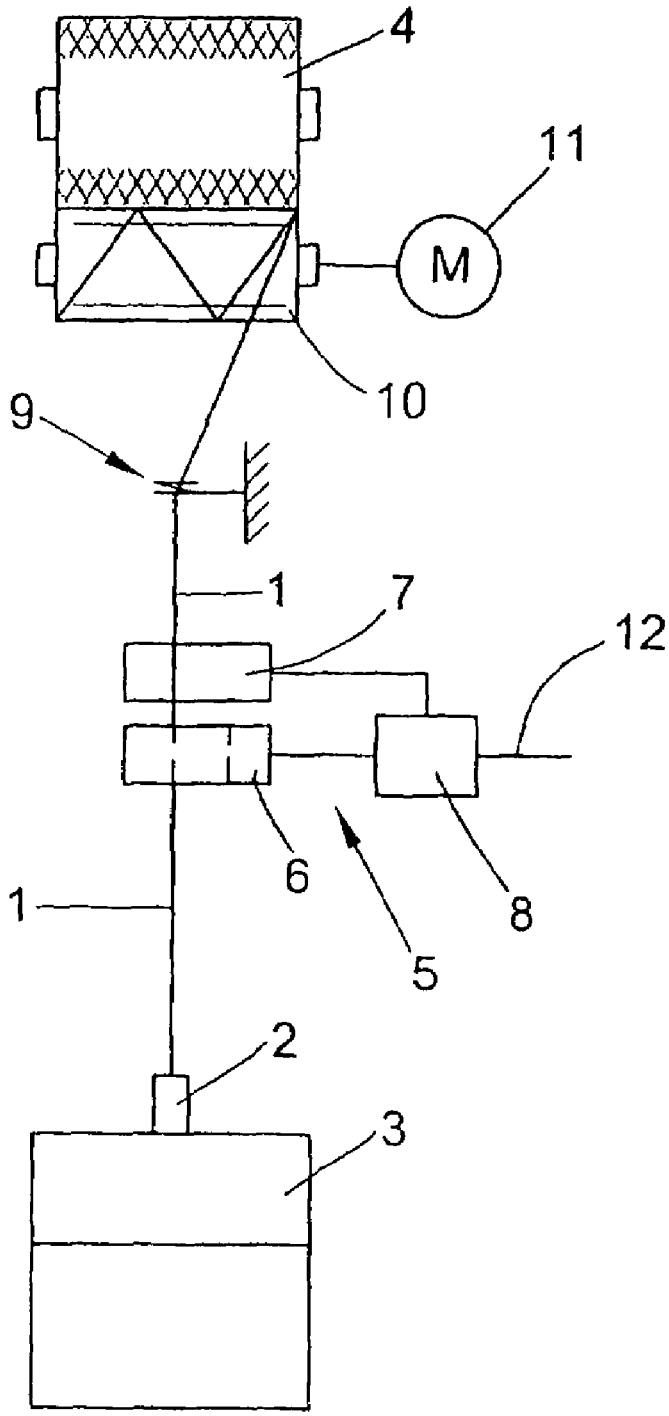
FIG. 1 shows a simplified schematic view of a workstation of a spinning winding machine.

In the spinning station shown in FIG. 1, the effect yarn 1 is drawn off from the spinning device 3 through the draw-off tube 2 and wound onto the cross-wound bobbin 4. The effect yarn 1 runs between the spinning device 3 and cross-wound bobbin 4, through a yarn cleaner 5, which comprises a measuring head 6 and a processor 8, and subsequently a guide eyelet 9. The yarn cleaner 5 is allocated a thread guard 7. The drive drum 10 drives the cross-wound bobbin 4 during winding process by the means of frictional engagement. A motor 11 provides the drive drum 10 with rotational movement. The yarn cleaner 5 is used for quality monitoring of the running effect yarn 1. The yarn cleaner 5 is connected to further mechanisms for control, data storage or evaluation and for the activation of further elements of the spinning station or the spinning machine, by means of the line 12. The components of the yarn cleaner 5 can be integrated in a common housing.

Alternatively, the effect yarn may also be drawn from a supply bobbin instead of from a spinning device.

Figure 2:
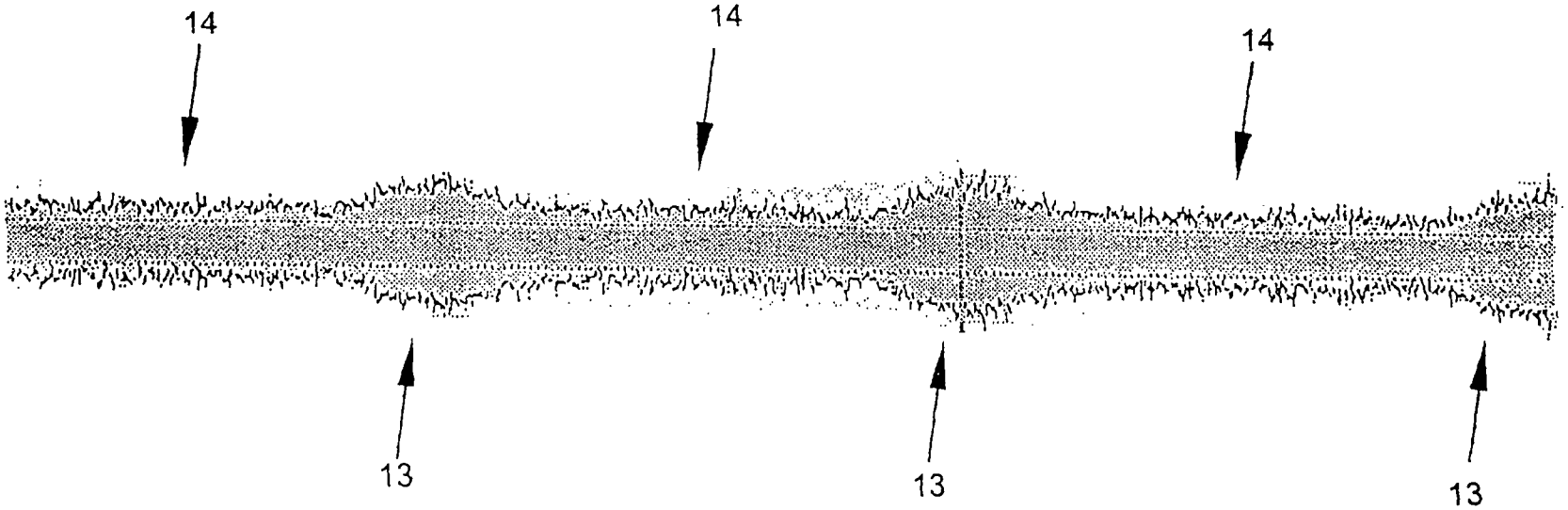
FIG. 2 shows an effect yarn, which is shown by the arrangement side by side of measured values of the yarn diameter.

FIG. 2 shows the view of the effect yarn 1 as an arrangement side by side of measured values. The regions of the effects 13 and the webs 14 can be seen but the beginning and end of the effects 13 and the effect thickness or the effect diameter $D_E$ and the web thickness or the web diameter $D_{ST}$ are not clear and therefore cannot be adequately recognized.

The yarn cleaner 5 records the yarn diameter D in each case at a spacing of 2 mm. A cycle represents a measuring length of 2 mm of effect yarn 1. To determine the web diameter $D_{ST}$ used as a basis for the cleaning, the cleaner 5 initially forms, at the beginning of the measurement, an arithmetic average value of the yarn diameter from a predetermined length of effect yarn 1 as the reference diameter, subtracts the reference diameter from the measured individual values of the yarn diameter and forms the average value of the web diameter $D_{ST}$ as the arithmetic average value from all the negative differential values, which have been measured adjacent to other negative differential values.

Figure 3:
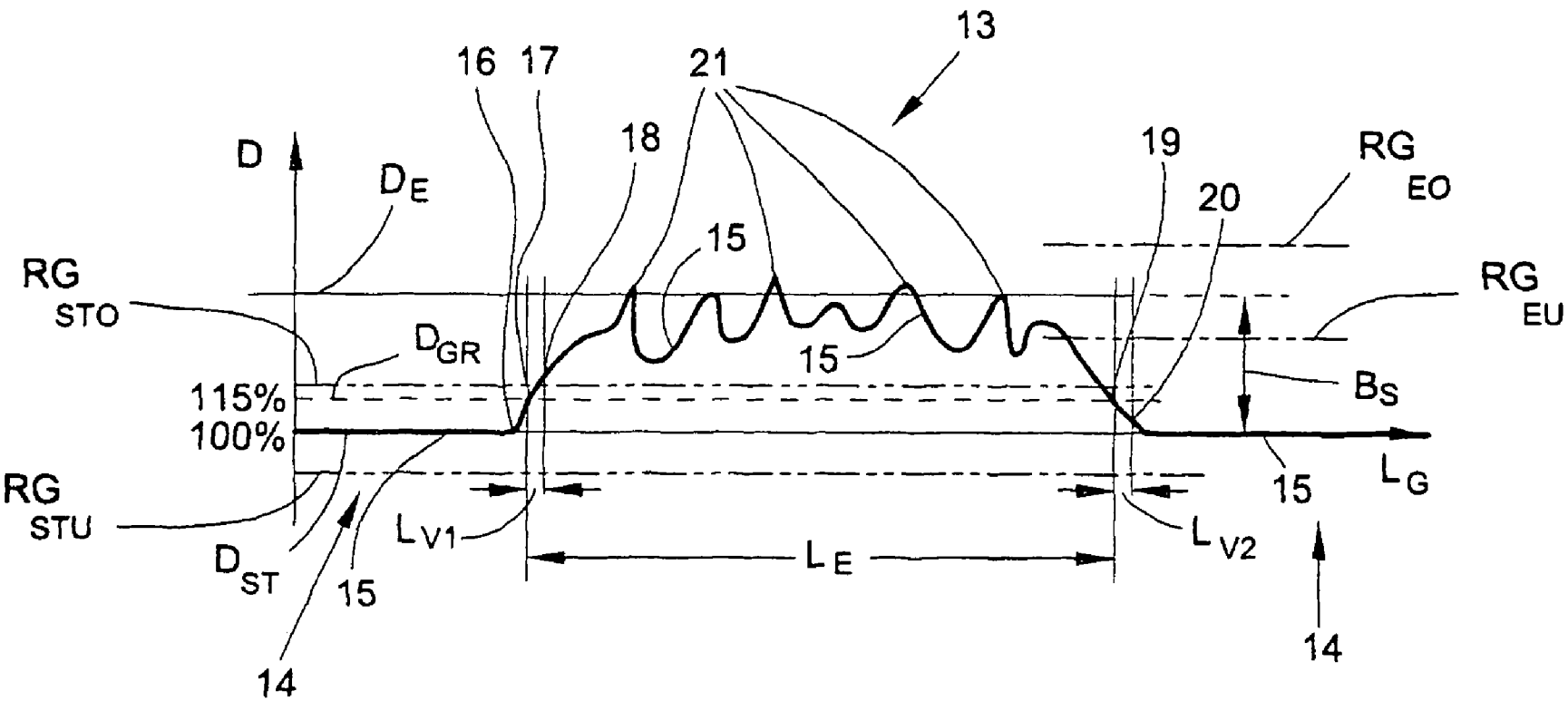
FIG. 3 shows a basic view of an effect region with adjacent web parts.

The determination of the effect diameter $D_E$ and the limits between the effects 13 and webs 14 is explained with the aid of FIG. 3. In the view of FIG. 3, the yarn diameter D is shown as a percentage over the yarn length $L_G$ as the curve 15. The curve 15 represents, in the view of FIG. 3, beginning from the left up to the point 16, the web diameter $Ds_T$. From the point 16, the curve 15 rises and, at point 17, passes the value of the limit diameter $D_{GR}$. At point 18, the predetermined yarn length Lv has been covered since reaching the point 17. After a diameter increase of 15% is recorded at the point 17, and the exceeding of the limit diameter $D_{GR}$ lasts over the predetermined length Lv, for example for six cycles or 12 mm, the point 17 is defined as the beginning of the effect 13. The curve 15 falls below the limit diameter $D_{GR}$ at the point 19. The falling below lasts up to point 20 and therefore over the predetermined yarn length Lv. Therefore, the point 19 is defined as the end of the effect 13. The region between point 17 and point 19 is defined as the effect 13. The section of the effect yarn 1 following after point 19 or the end of the effect 13 is defined as web 14 until a beginning of an effect 13 is determined again.

An arithmetic average value is formed from the four largest diameters 21 within the effect 13. The provision of the effect diameter $D_E$ is thus largely independent of natural diameter fluctuations in the effect region. This arithmetic average value is defined as the effect diameter $D_E$.

A predetermined tolerance range with a cleaning limit $RG_{EO}$ as the upper limit value and with a cleaning limit $RG_{EU}$ as the lower limit value, is allocated to the effect diameter $D_E$. A predetermined tolerance range with a cleaning limit $RG_{STO}$ as the upper limit value and with a cleaning limit $RG_{STU}$ as the lower limit value is accordingly allocated to the web diameter $D_{ST}$.

The yarn cleaner 5 continuously determines whether the diameter values of the effect yarn 1 detected by the measuring head 6 originate from a region which is defined as a web 14 or as an effect 13. If the diameter values of the effect yarn 1 originate from a region, which is defined as a web 14, these diameter values are compared with the limit values allocated to the web diameter $D_{ST}$, the cleaning limit $RG_{STO}$ and the cleaning limit $RG_{STU}$. If the diameter values of the effect yarn 1 originate from a region, which is defined as an effect 13, these diameter values are compared with the limit values allocated to the effect diameter $D_E$, the cleaning limit $RG_{EO}$ and the cleaning limit $RG_{EU}$.

Alternatively, the yarn cleaner 5 can be set up in such a way that, alternatively, either only defects in the web regions or only defects in the effect regions are cleaned out.

Alternatively, the cleaning limits of the yarn cleaner 5 can be set up in such a way that they lie outside the fluctuation width $B_s$ identified in FIG. 3, of the effect 13 and web 14. The fluctuation width Bs designates the spacing between the diameter of the effect 13 and the diameter of the web 14. In this case, the continuously measured diameter values of the effect yarn 1 are compared, for example, only with the cleaning limit $RG_{EO}$ and the cleaning limit $RG_{STU}$, in order to detect exceeding. The cleaning limit $RG_{EO}$ designates the upper tolerable limit value of the effect diameter $D_E$ and the cleaning limit $RG_{STU}$ designates the lower tolerable limit value of the web diameter $D_{ST}$.

In a first embodiment, the yarn cleaner 5 is set up in such a way that exceeding these limit values or cleaning limits is recorded as an intolerable defect and the latter is cut out.

In a second embodiment, the yarn cleaner 5 is alternatively set up in such a way that when these limit values or cleaning limits are exceeded, it is detected over what yarn length the exceeding lasts. A decision is made by means of a two-dimensional classifying matrix known per se, also called a cleaner matrix, as to whether an intolerable defect is present and, in this manner, the defect lengths are included in the determination of the cleaning limits. A classifying matrix is divided in one dimension into length regions and, in the other dimension, into diameter regions and, in each case, forms a class by the combination of one length region with one diameter region. The cleaning of yarn according to classes has been known for a long time, for example from the literature reference "Vollständiges System zur Qualitätssicherung in der Spulerei", Melliand—offprint October 1992.

Further embodiments of the yarn cleaner are possible in the framework of the invention and not limited to the embodiment shown.

The invention claimed is:

1. Yarn cleaner for cleaning out defects from yarn, in the measuring head of which at least one yarn parameter is measured, wherein for the yarn parameter, cleaning limits are determined, the exceeding of which signals the presence of a defect in the yarn, for which purpose the measured values of the yarn parameter are compared with the cleaning limits and wherein intolerable defects are cut out from the yarn, characterized in that the yarn cleaner is set up for cleaning effect yarn (1) with at least one cleaning limit, wherein the effect yarn (1) is formed from an alternating arrangement end to end of webs (14) and of effects (13) consisting of predetermined thickenings, and wherein the at least one cleaning limit comprises either (a) at least one cleaning limit for web regions defining a predetermined uppermost value of the yarn parameter measured in web regions of the effect yarn which is less than a predetermined acceptable value of the yarn parameter for effect regions, (b) at least one cleaning limit for effect regions defining a predetermined lowermost value of the yarn parameter measured in effect regions of the effect yarn which is greater than a predetermined acceptable value of the yarn parameter for web regions, or (c) both the at least one cleaning limit for web regions which defines the uppermost value of the yarn parameter measured in web regions of the effect yarn and the at least one cleaning limit for effect regions which defines the lowermost value of the yarn parameter measured in effect regions of the effect yarn.

2. Yarn cleaner according to claim 1, characterized in that the yarn cleaner (5) is set up to implement yarn cleaner functions, known per se, in such a way that at least one of the following defects is detectable:

short thick location, long thick location, short thin location, long thin location, and periodically recurring defects.

3. Yarn cleaner according to claim 1, characterized in that the yarn cleaner (5) is set up in such a way that, alternatively, either only defects in the web regions are cleaned out or only defects in the effect regions are cleaned out.

4. Yarn cleaner according to claim 1, characterized in that the yarn parameter is the diameter of the effect yarn (1), in that the cleaning limits of the yarn cleaner (5) are matched to at least one diameter value for the effect thickness and to at least one diameter value for the web thickness.

5. Yarn cleaner according to claim 4, characterized in that the yarn cleaner (5) is set up in such a way that it determines, over a predetermined yarn length, the average diameter values of the webs (14) and the average diameter values of the effects (13), and in that the determination of the average diameter values takes place at least at the beginning of the measurement.

6. Yarn cleaner according to claim 4, characterized in that the defect lengths are included in the determination of the cleaning limits.

7. Yarn cleaner according to claim 4, characterized in that, to determine the average value of the web diameter $D_{ST}$, the yarn cleaner (5) initially forms a reference diameter equal to an arithmetic average value of the yarn diameter from a predetermined length of effect yarn (1), subtracts the reference diameter from the individual values of the yarn diameter and forms the average value of the web diameter $D_{ST}$ as the arithmetic average value of all the negative differential values, which have been measured adjacent to other negative differential values.

8. Yarn cleaner according to claim 4, characterized in that the yarn cleaner (5) is set up such that it determines the effect region in that the beginning of the effect (13) is defined by fulfilling a first criterion and in that the end of the effect is defined by fulfilling a second criterion, between the beginning and the end of the effect (13), a specifiable number of the largest diameters is determined, an arithmetic average value is formed from the diameters determined, which is specified as the diameter of the effect (13), and the region of the effect yarn (1) outside the effect (13) is defined as the web region.

9. Yarn cleaner according to claim 8, characterized in that the diameter $D_E$ of the effect (13) is formed as the average diameter value from the four largest diameters between the beginning and end of the effect (13).

10. Yarn cleaner according to claim 8, characterized in that, considered as the first criterion is the exceeding of a limit diameter $D_{GR}$, which is greater by a defined amount than the average value of the web diameter $D_{ST}$ and in that the exceeding lasts over a predetermined yarn length $L_{V1}$ and in that, considered as the second criterion is the falling below of the limit diameter $D_{GR}$ and the fact that the falling below lasts over the predetermined yarn length $L_{V2}$.

11. Yarn cleaner for cleaning out defects from a yarn, in the measuring head of which at least one yarn parameter is measured, wherein for the yarn parameter, cleaning limits are determined, the exceeding of which signals the presence of a defect in the yarn, for which purpose the measured values of the yarn parameter are compared with the cleaning limits and wherein intolerable defects are cut out from the yarn, characterized in that the yarn cleaner is set up for cleaning effect yarn (1) with at least one cleaning limit, which is valid for values of the yarn parameter measured in web regions of the effect yarn (1), and additionally with at least one cleaning limit, which is valid for values of the yarn parameter measured in effect regions of the effect yarn (1), in that the at least one cleaning limit for web regions does not coincide with the predetermined value of the yarn parameter for web regions and in that the at least one cleaning limit for effect regions does not coincide with the predetermined value of the yarn parameter for effect regions, and wherein the effect yarn (1) is formed from an alternating arrangement side by side of webs (14) and of effects (13) consisting of predetermined thickenings, characterized further in that the yarn Parameter is the diameter of the effect yarn (1), in that the cleaning limits of the yarn cleaner (5) are matched to at least one diameter value for the effect thickness and to at least one diameter value for the web thickness.

12. Yarn cleaner according to claim 11, characterized in that the yarn cleaner (5) is set up in such a way that it determines, over a predetermined yarn length, the average diameter values of the webs (14) and the average diameter values of the effects (13), and in that the determination of the average diameter values takes place at least at the beginning of the measurement.

13. Yarn cleaner according to claim 11, characterized in that the defect lengths are included in the determination of the cleaning limits.

14. Yarn cleaner according to claim 11, characterized in that, to determine the average value of the web diameter $D_{ST}$, the yarn cleaner (5) initially forms a reference diameter equal to an arithmetic average value of the yarn diameter from a predetermined length of effect yarn (1), subtracts the reference diameter from the individual values of the yarn diameter and forms the average value of the web diameter $D_{ST}$ as the arithmetic average value of all the negative differential values, which have been measured adjacent to other negative differential values.

15. Yarn cleaner according to claim 11, characterized in that the yarn cleaner (5) is set up such that it determines the effect region in that the beginning of the effect (13) is defined by fulfilling a first criterion and in that the end of the effect is defined by fulfilling a second criterion, between the beginning and the end of the effect (13), a specifiable number of the largest diameters is determined, an arithmetic average value is formed from the diameters determined, which is specified as the diameter of the effect (13), and the region of the effect yarn (1) outside the effect (13) is defined as the web region.

16. Yarn cleaner according to claim 15, characterized in that the diameter $D_E$ of the effect (13) is formed as the average diameter value from the four largest diameters between the beginning and end of the effect (13).

17. Yarn cleaner according to claim 15, characterized in that, considered as the first criterion is the exceeding of a limit diameter $D_{GR}$, which is greater by a defined amount than the average value of the web diameter $D_{ST}$ and in that the exceeding lasts over a predetermined yarn length $L_{V1}$ and in that, considered as the second criterion is the falling below of the limit diameter $D_{GR}$ and the fact that the falling below lasts over the predetermined yarn length $L_{V2}$.

* * * * *